US006517586B2

(12) United States Patent
Lin

(10) Patent No.: US 6,517,586 B2
(45) Date of Patent: Feb. 11, 2003

(54) SUPPORT APPARATUS

(76) Inventor: Joe Lin, No. 4, Alley 32, Lane 148, Sec. 2, Fu-Hsing, Taipei City (TW)

( * ) Notice: Subject to any disclaimer, the term of this patent is extended or adjusted under 35 U.S.C. 154(b) by 0 days.

(21) Appl. No.: 09/737,493

(22) Filed: Dec. 18, 2000

(65) Prior Publication Data

US 2002/0077704 A1 Jun. 20, 2002

(51) Int. Cl.[7] ..... A61F 2/60; A63B 25/00
(52) U.S. Cl. ..... 623/28; 482/75
(58) Field of Search ..... 623/28; 482/75, 482/76

(56) References Cited

U.S. PATENT DOCUMENTS 1,905,112 A * 4/1933 Lang ..... 3/4
2,057,013 A * 10/1936 Curtis ..... 3/4
3,102,272 A * 9/1963 Emmert ..... 3/4
3,346,882 A * 10/1967 Wilhoyte ..... 3/4
3,626,519 A * 12/1971 Baker ..... 3/4
3,902,199 A * 9/1975 Emmert ..... 3/4
5,645,515 A * 7/1997 Armstrong et al. ..... 482/75

* cited by examiner

*Primary Examiner*—Bruce Snow
(74) *Attorney, Agent, or Firm*—Bacon & Thomas, PLLC

(57) ABSTRACT

A support structure having a shoe platform and a floor platform, with the said shoe platform and floor platform movably conjoined, and retained by a sprung component, to a set of supports. Moreover, there are a plurality of leg section supports that are coupled to one of the supports by means of a pivot sleeve having an axial hole and a locating mount. Movably conjoined between the leg section supports is an adjustable calf harness consisting of two adjoined fittings. The shoe platform includes heel rest consisting of a stop mount and a slide mount having selectable position mounting holes. Disposed on the shoe platform are clasp mounts for the positioning of toe straps and strap fastener as well as ankle straps and strap fasteners into shoe platform clasp slots.

12 Claims, 4 Drawing Sheets

*F I G 1* (PRIOR ART)

SUPPORT APPARATUS

BACKGROUND OF THE INVENTION

1) Field of the Invention

The invention herein relates to a support apparatus that addresses variances in the physical constitution of different work personnel by allowing adjustments for calf and sole length, morphology, and dimensions.

2) Description of the Related Art

U.S. Pat. No. 5,645,515 provides an elevated support apparatus that enables a person to undertake construction in high places; the structure, as indicated in FIG. 1, of the said support apparatus 1 is equipped with a shoe platform 11 and a floor platform 12, and the shoe platform 11 and floor platform 12 are movably conjoined to a set of supports 13; support mounts 131, 132, and 133 are maintained on a center rod 134 by elastic components 135 and 136; a leg section support 14 is movably conjoined to one of the supports 13 by a fixing mount 15, and a collar mount 16 couples the shoe platform 11; the shoe platform 11 has disposed on it a toe strap 171 and an ankle strap 172, and the leg section support 14 has disposed on it a calf support 18 and a calf strap 19; during utilization, the soles of the feet are situated on the shoe platform 11 such that the calf is against the calf support 18, following which the toe strap 171, the ankle strap 172, and then the calf strap 19 are tightened; however, relying on only a single support 13 easily leads to injury or instability; furthermore, since the calf support 18 on the support 13 is incapable of being adjusted for the differences in calf size among individuals, strapping to the calf support 18 could cause inconvenience or discomfort; when a rest break is taken and the apparatus has to worn once again, the location of the soles may change and the toe strap 171, ankle strap 172, and the calf strap 19 must be re-adjusted, a time-consuming task that is bothersome and impractical.

SUMMARY OF THE INVENTION

The objective of the invention herein is to provide an improved support apparatus comprised of a shoe platform and a floor platform, with the said shoe platform and floor platform movably conjoined, and retained by a sprung component, to a set of supports such that the leg section support is moved through the said axial hole, the extending locating mount is positioned into a mounting bracket at the side of the shoe platform, and the fastening component is inserted onto the mounting bracket and the locating mount to thereby appropriately position both the pivot sleeve and the leg section support on the mounting bracket; movably conjoined between the leg section supports is an adjustable calf harness consisting of two adjoined fittings; the said shoe platform includes a heel rest consisting of a stop mount and a slide mount having selectable position mounting holes; and disposed at the same time on the shoe platform are toe straps and ankle straps, with each having clasp mounts that are respectively positioned into the area of the shoe platform clasp slots, and the toe straps and ankle straps are inserted into a respective corresponding toe strap buckle and ankle strap buckle; and a strap fastener is situated on the toe strap buckle and ankle strap buckle and the said strap fasteners are similarly equipped with clasp mounts that are positioned into the clasp slot area of the shoe platform.

BRIEF DESCRIPTION OF THE DRAWINGS

Other features and advantages of the invention herein shall become apparent in the following detailed description of the preferred embodiment, with reference to the drawings below, in which.

DETAILED DESCRIPTION OF THE PREFERRED EMBODIMENT

Figure 1:
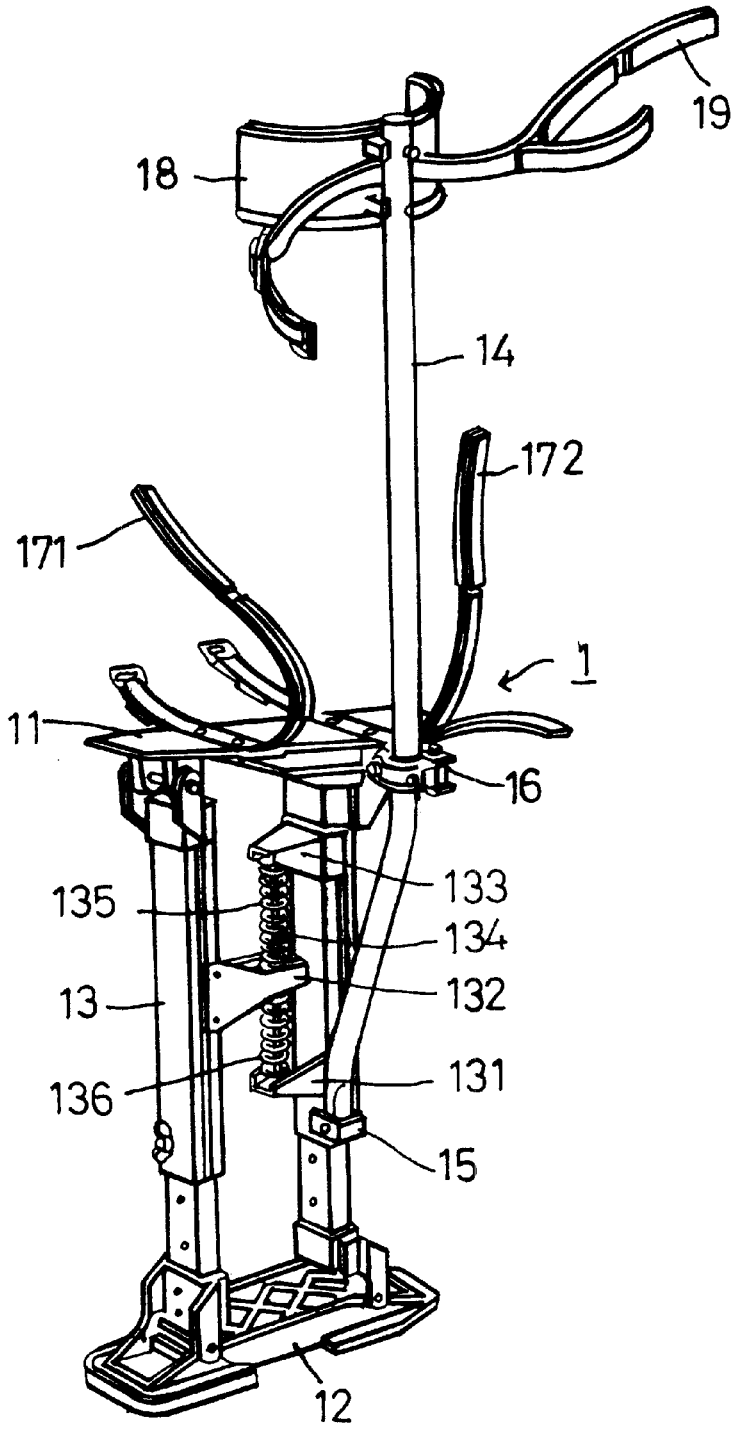
FIG. 1 is an isometric drawing of a conventional support apparatus.

In the detailed description of the preferred embodiment, similar elements are indicated by the same series of reference numerals throughout the disclosure.

Figure 2:
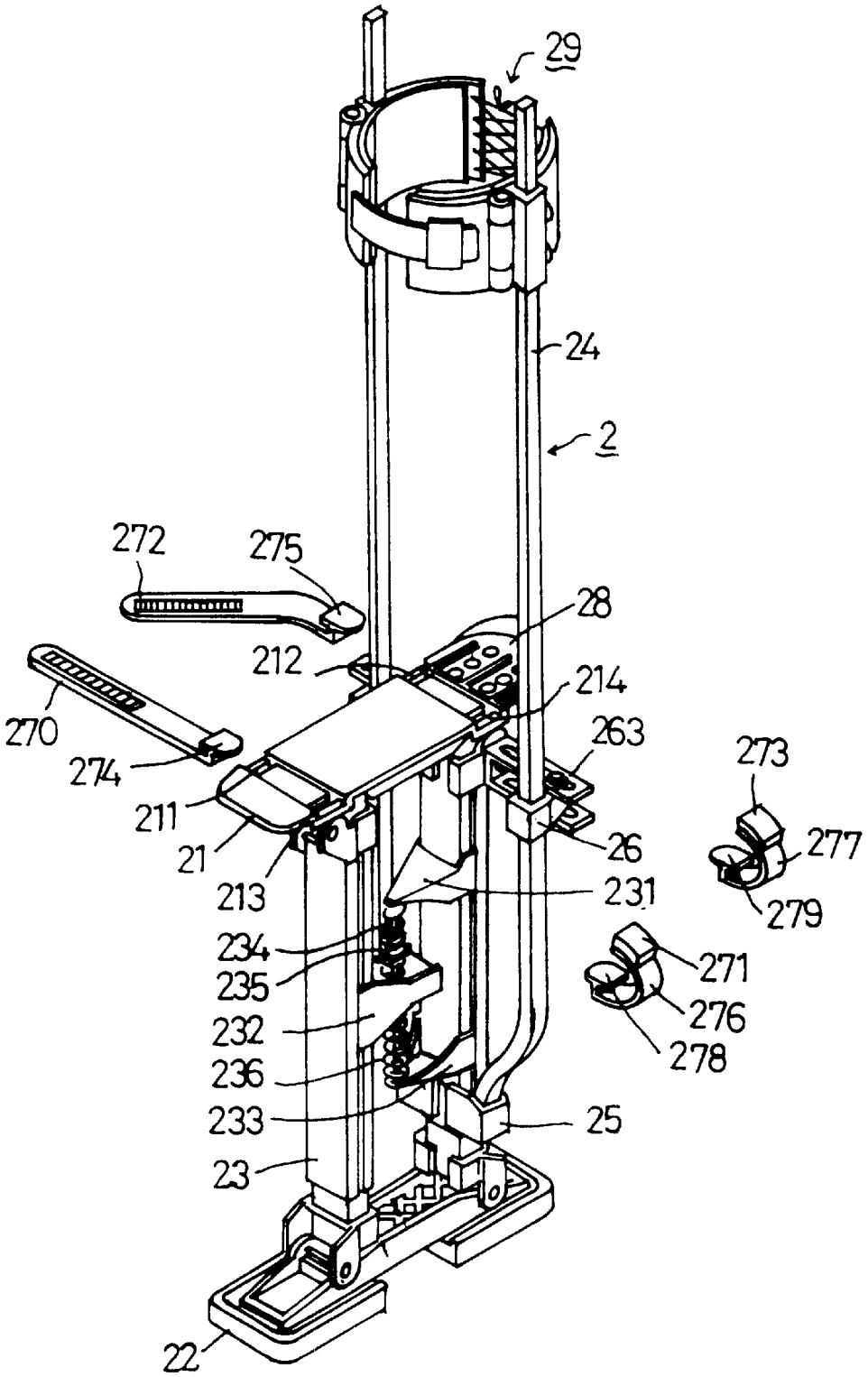
FIG. 2 is an isometric drawing of the support apparatus in the preferred embodiment of the invention herein.

Referring to FIG. 2, in the preferred embodiment of the invention herein, the support structure 2 includes a shoe platform 21 and a floor platform 22, with the shoe platform 21 and floor platform 22 movably conjoined to a set of supports 23. The shoe platform 21 and the floor platform 22 are generally maintained as a parallel, quadrilateral structure relative to the supports 23, and situated on the supports 23 are abutments 231, 232, and 233 as well as a center rod 234 and elastic retaining components 235 and 236 that provide for the flexible canting of the supports 23. Two leg sections supports 24 are coupled to one of the supports 23 and the shoe platform 21, wherein each leg section support 24 is movably conjoined via a fixing mount 25 to the support 23 and is each connected via a pivot sleeve 26 to the shoe platform 21. Installed on the shoe platform 21 is a toe strap 270 and a toe strap buckle 271 as well as an ankle strap 272 and an ankle strap buckle 273 that provides for tightening down the sole of the feet and, disposed at one end of the shoe platform 21 is a heel rest 28, and a calf harness 29 is installed between the two leg section supports 24.

The toe strap 270 and toe strap buckle 271 each have a T-shaped clasp mount 274 and 275 that are respectively positioned into the area of a clasp slot 211 and 212 of the shoe platform 21, and the toe strap buckle 271 is of a curved profile; additionally, equipped on both the toe strap buckle 271 and the ankle strap buckle 273 is a strap fastener 276 and 277 that similarly have a T-shaped clasp mount 278 and 279 which are positioned into the area of a clasp slot 213 and 214 of the shoe platform 21; and the structure of the toe strap buckle 271 and the ankle strap buckle 273 is similar in arrangement to that of the insert mount 32 on the calf harness 29.

Figure 3:
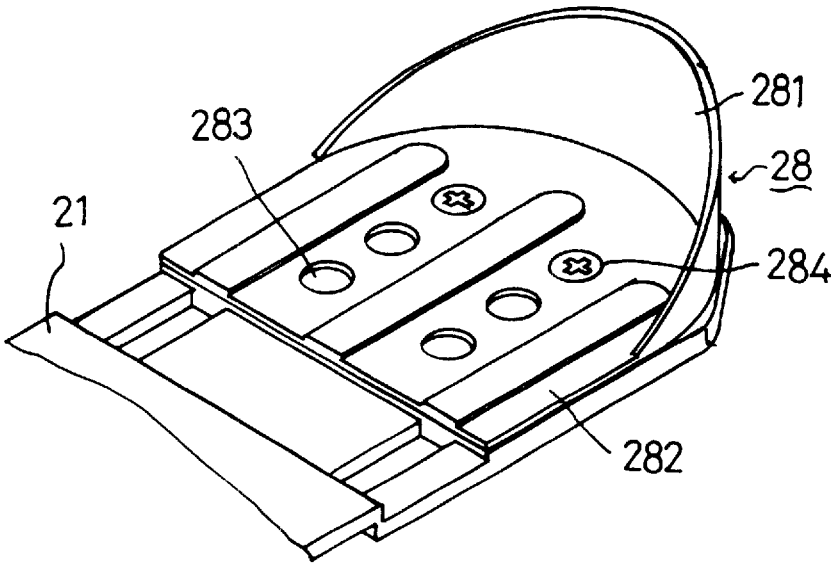
FIG. 3 is an isometric drawing of the heel rest structure in the preferred embodiment of the invention herein.

Referring to FIG. 3, the heel rest 28 disposed at one end of the shoe platform 21 consists of a vertically situated curved stop mount 281 and a slide mount 282 movably conjoined onto the shoe platform 21; the slide mount 282 has numerous mounting holes 283 and fastening components 284 can be selectively screw fastened into any of the mounting holes 284 as per requirements.

Figure 4:
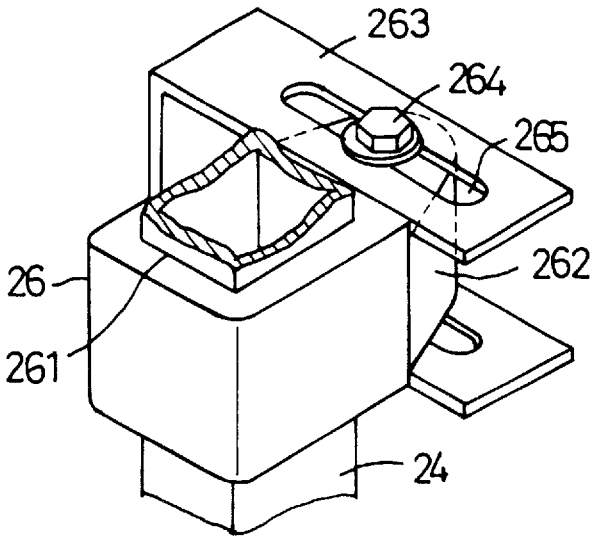
FIG. 4 is an isometric drawing of the pivot sleeve structure in the preferred embodiment of the invention herein.

Referring to FIG. 4, the said two leg section supports 24 consist of square cut-surfaced tubing with a square axial hole 261 through the center of its pivot sleeve 26, with the pivot sleeve 26 having a locating mount 262 extending into a mounting bracket 263; a fastening component 264 is inserted through the elongated hole 265 of the mounting bracket 263 and the locating mount 262 protruding from the pivot sleeve 26 such that the pivot sleeve 26 can be appropriately positioned on a leg section support 24 by securing the mounting bracket 263.

Figure 5:
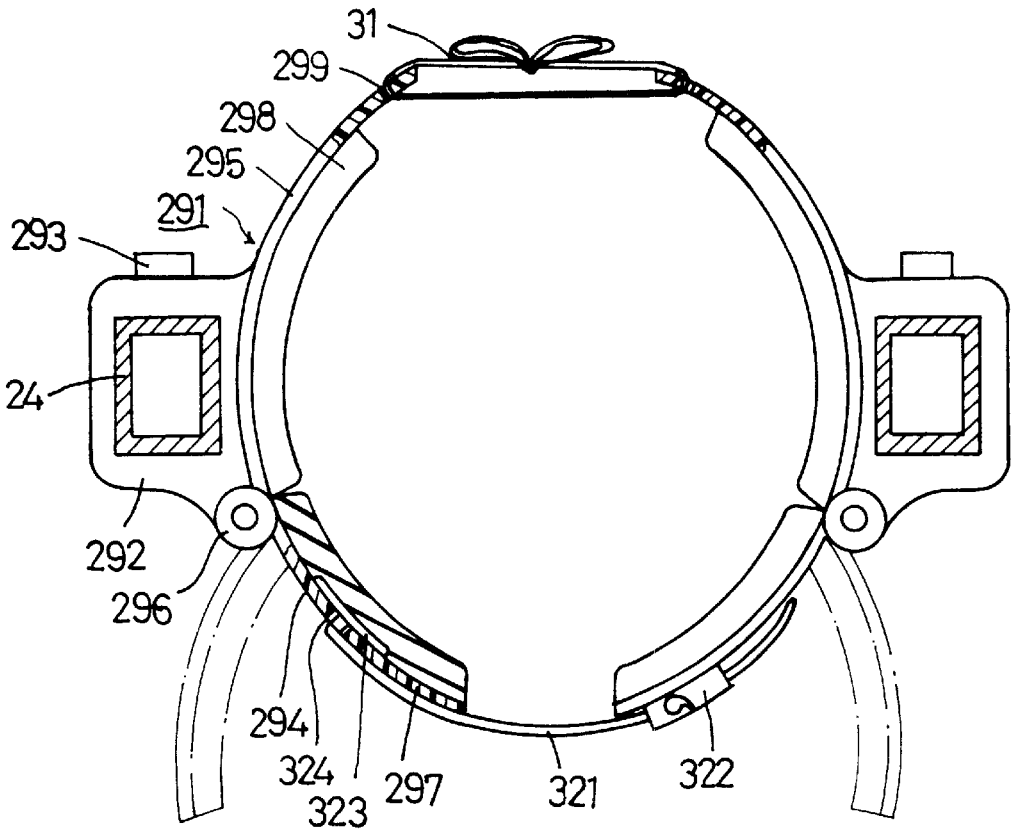
FIG. 5 is an orthographic drawing of the calf harness structure in the preferred embodiment of the invention herein.

Referring to FIG. 5, the calf harness 29 consists of two semicircular adjoined fittings 291; each adjoined fitting 291 has disposed at their concave profiled back portion a mounting sleeve 292 movably conjoined longitudinally onto a leg section support 24, the concave profile openings are of a mutually facing arrangement and, furthermore, on the mounting sleeve 292 is a fastening component 293 that is screwed against the side of the leg section support 24 such that the adjoined fittings 291 are secured into position on the leg section support 24; each adjoined fitting 291 consists of a front adjoined fitting 294 situated at the anterior end and a rear adjoined fitting 295 situated at the posterior end, with both movably conjoined by a hinge section 296; the rear adjoined fitting 295 and the mounting sleeve 292 are a single physical entity and the front adjoined fitting 294 can be lifted open; the front adjoined fitting 294 and the rear adjoined fitting 295 have along their outer sides a curved plate 297 constructed of a relatively hard material and along the inner sides of the concave is a protective padding 298 made of a soft material; aligned on each of the two rear adjoined fittings 295 are a plurality of upper and lower arrayed through-holes 299 that are secured together in an overlapping arrangement by a first fastening component 31; furthermore, at the aligned side of the two front adjoined fittings 294 is a second fastening component 32 that secures this area, which also includes a strap fastener 321 and an insert mount 322, the strap fastener 321 having a T-shaped clasp mount 323 that is positioned into the area of the clasp slot 324 formed in the front adjoined fitting 294; and the insert mount 322 is fixed into position onto the plate 297 of the other front adjoined fitting 294.

Figure 6:
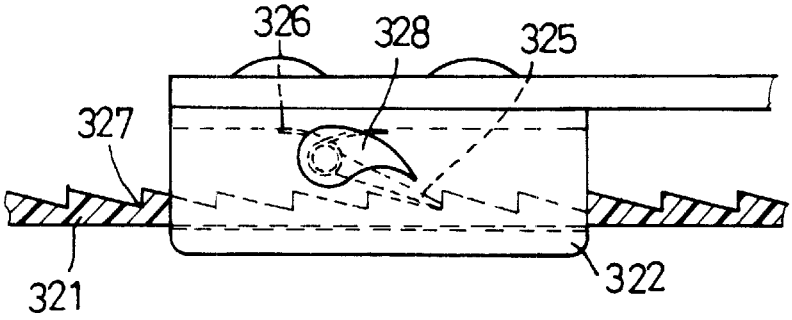
FIG. 6 is an invisible drawing of the insert mount structure in the preferred embodiment of the invention herein.

Referring to FIG. 6, the said insert mount 322 has movably situated inside a rack piece 325 that is utilized in conjunction with an elastic component 326 which engages the toothed section 327 of the rack piece 325 in the insert mount 322 and, furthermore, engagement is released by the operation a swinging body 328 outside the insert mount 322.

In terms of utilization, the front adjoined fitting 294 is first lifted open for placement around the calf and, furthermore, the two adjoined fittings 291 are moved up and down the leg section supports 24 to find an appropriate position and then the fastening component 293 is screwed in to fix the position; after adjusting the stop mount 281 of the heel rest 28 against the heel, the fastening components 284 are fastened in the appropriate mounting holes 283; following which the two pivot sleeves 26 are moved and positioned together on the leg section supports 24 and secured by the mounting bracket 263 at an appropriate position; the first fastening component 31 is adjusted so that the calf is comfortably contained within the calf harness 29; after which the toe strap 270 and toe strap buckle 271 as well as the ankle strap 272 and an ankle strap buckle 273 are utilized to tighten down the soles of the feet, and then strap fasteners 321 and the insert mounts 322 of the front adjoined fittings 294 are firmly inserted.

In the invention herein, the structure of the preferred embodiment has the following advantages:

1. The design of the two sets of leg section supports 24 preclude calf slippage and injury of working personnel, the stability achieved preventing occupational injury.
2. The calf harness 29 are movable in position up and down the leg section support 24 to accommodate the varying calf lengths of different working personnel.
3. The leg section supports 24 are square tubing with simple matching pivot sleeves 26, the design of which is simpler in structure than the conventional collar mount 16 and the pivot sleeves 26 can be simply positioned at an appropriate place along the leg section supports 24 on the mounting bracket 263.
4. The adjustability of the heel rest 28 solves the problem of the heel slipping backwards, while providing usability by different working personnel.
5. After the two rear adjoined fittings 295 are adjusted and tightly secured by the first fastening component 31, the same worker can wear and re-wear the apparatus many times, and following the placement of the calf into the two rear adjoined fittings 295 simply slip the strap fasteners 321 into the insert mounts 322 to rapidly wear the apparatus comfortably.
6. The toe strap 270 and the toe strap buckle 271 as well as the ankle strap 272 and the ankle strap buckle 273 can be securely positioned rapidly and easily.

While the present invention has been described in relation to what is considered the most practical and preferred embodiment, it is understood that the invention herein shall not be limited to the disclosed embodiment, but is intended to cover the various arrangements included within the spirit and scope of the broadest interpretations and equivalent arrangements.

What is claimed is:

1. A support structure comprising:

a shoe platform and a floor platform, with the shoe platform and the floor platform movably conjoined, and retained by a spring component to a set of supports;

the shoe platform and the floor platform are generally maintained as a parallel, quadrilateral structure relative to the supports and a pair of leg section supports are coupled to a first one the supports and the shoe platform, the leg section supports extend from one of the supports and the leg section supports are substantially parallel to each other;

a calf harness is installed between the leg supports, the calf harness comprises two semicircular adjoined fittings that are each attached to a respective one of the leg section supports and the fittings are each opposingly aligned and movably conjoined longitudinally onto one of the leg section supports, and fastening components are secured into position on the leg section supports.

2. The support structure as claimed in claim 1, wherein each of the adjoined fitting comprises a front adjoined fitting situated at the anterior end thereof and a rear adjoined fitting situated at the posterior end thereof, the fittings are movably conjoined by a hinge section, the rear adjoined fitting and a mounting sleeve are united as one, and the mounting sleeve is movably conjoined to the leg section support.

3. The support structure as claimed in claim 2, wherein the fastening component is installed onto the mounting sleeve.

4. The support structure as claimed in claim 2, wherein the rear adjoined fittings have a plurality of upper and lower arrayed through-holes that are secured together in an overlapping arrangement by a first fastening component.

5. The support structure as claimed in claim 2, wherein at the aligned side of the two of the front adjoined fittings there is a second fastening component that secures this area.

6. The support structure as claimed in claim 5, wherein the second fastening component includes a strap fastener and an insert mount, the strap fastener has situated on it a clasp mount that is positioned into the area of a clasp slot formed in the front adjoined fitting; and the insert mount is situated on the strap fastener and the strap fastener similarly has a T-shaped clasp mount that is positioned into the area of the clasp slot formed in the front adjoined fitting.

7. The support structure as claimed in claim 6, wherein the insert mount has movably situated inside a rack piece that is utilized in conjunction with an elastic component which engages a toothed section of a rack piece in the insert mount and, engagement is released by the operation of a swinging body outside the insert mount.

8. The support structure as claimed in claim 1, wherein the front adjoined fitting and the rear adjoined fitting have along their outer sides a curved plate constructed of a relatively hard material and along their inner sides is a protective padding made of a soft material.

9. The support structure as claimed in claim 1, wherein the leg section supports comprises square cut-surfaced tubing.

10. The support structure as claimed in claim 1, wherein the leg section support is coupled to one of the supports and the shoe platform by the pivot sleeve having an axial hole and the locating mount such that the leg section support is moved through the axial hole, and an extending locating mount is positioned into a mounting bracket at the side of the shoe platform, and the fastening component is inserted onto the mounting bracket and the locating mount to thereby appropriately position both the pivot sleeve and the leg section support on the mounting bracket.

11. The support structure as claimed in claim 1, wherein disposed at one end of the shoe platform is a heel rest comprising a stop mount and a slide mount on the shoe platform; and the slide mount comprises a plurality of mounting holes and the fastening components can be selectively fixed in the mounting holes.

12. The support structure as claimed in claim 1, wherein installed on the shoe platform is a toe strap and an ankle strap, the toe strap and the ankle strap are each respectively positioned into an area of clasp slots of the shoe platform, and the toe strap and the ankle strap are each respectively inserted into a corresponding toe strap buckle and an ankle strap buckle; and equipped on both the toe strap buckle and the ankle strap buckle is a strap fastener, and the strap fastener is positioned into an area of the clasp mounts of the shoe platform.

* * * * *